US009957654B2

(12) United States Patent
Park et al.

(10) Patent No.: US 9,957,654 B2
(45) Date of Patent: May 1, 2018

(54) WASHING MACHINE

(75) Inventors: Jin Moo Park, Seoul (KR); Dong Won Kim, Seoul (KR); Byung Wook Min, Seoul (KR); Jeong Kyo Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 726 days.

(21) Appl. No.: 14/237,112

(22) PCT Filed: Mar. 23, 2012

(86) PCT No.: PCT/KR2012/002110
§ 371 (c)(1),
(2), (4) Date: Aug. 22, 2014

(87) PCT Pub. No.: WO2013/022164
PCT Pub. Date: Feb. 14, 2013

(65) Prior Publication Data

US 2014/0366589 A1 Dec. 18, 2014

(30) Foreign Application Priority Data

Aug. 10, 2011 (KR) ..... 10-2011-0079736

(51) Int. Cl.
*D06F 37/22* (2006.01)
*D06F 33/02* (2006.01)
*D06F 37/20* (2006.01)

(52) U.S. Cl.
CPC ..... *D06F 37/22* (2013.01); *D06F 33/02* (2013.01); *D06F 37/203* (2013.01); *D06F 37/225* (2013.01)

(58) Field of Classification Search
CPC ..... D06F 37/22; D06F 37/203; D06F 37/225; D06F 33/02
USPC ..... 68/140
See application file for complete search history.

(56) References Cited

U.S. PATENT DOCUMENTS

| | | | | |
|---|---|---|---|---|
| 4,432,253 A | 2/1984 | Kerlin | | |
| 5,453,598 A * | 9/1995 | Hackett | G01M 1/30 | 219/494 |
| 2008/0307833 A1* | 12/2008 | Chang | D06F 37/22 | 68/23.1 |

FOREIGN PATENT DOCUMENTS

| | | |
|---|---|---|
| EP | 296593 | 12/1988 |
| EP | 0296593 A1 | 12/1988 |
| JP | 2005-021505 | 1/2005 |
| KR | 1020110010945 A | 2/2011 |
| WO | 2011115384 A2 | 9/2011 |

* cited by examiner

*Primary Examiner* — Michael E Barr
*Assistant Examiner* — Tinsae Ayalew
(74) *Attorney, Agent, or Firm* — Dentons US LLP

(57) ABSTRACT

A washing machine actively resolving unbalancing is provided. The washing machine includes: a drum accommodating laundry and configured to be rotatable; a balancing unit moving along the circumference of the drum and changing the center of gravity of the drum; and a wireless power transmission unit wirelessly supplying power to the balancing unit.

17 Claims, 5 Drawing Sheets

[Fig. 1]
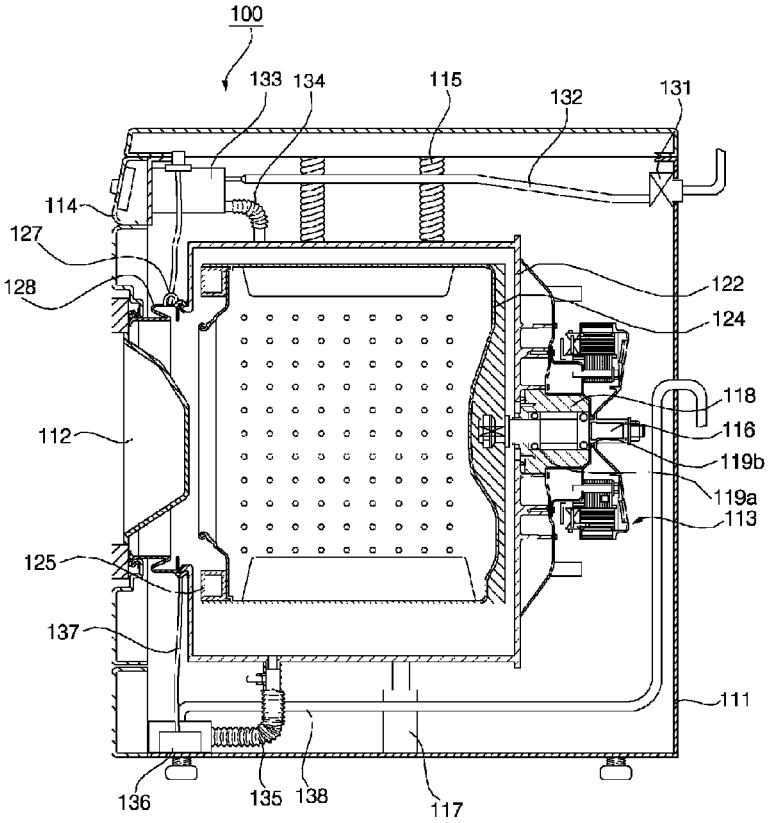
[Fig. 2]
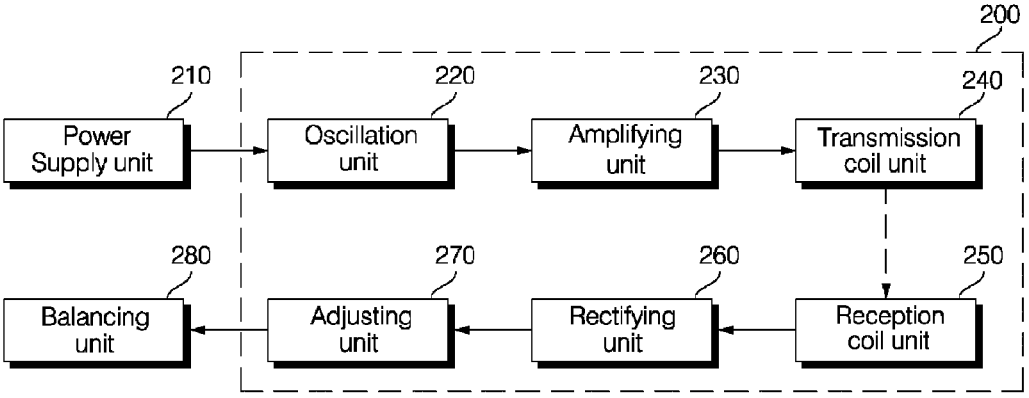

[Fig. 3]
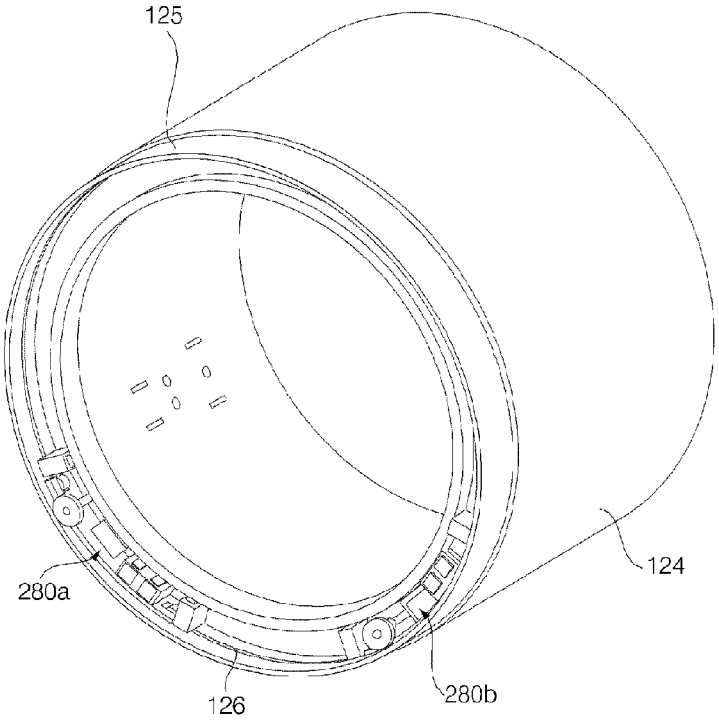
[Fig. 4]
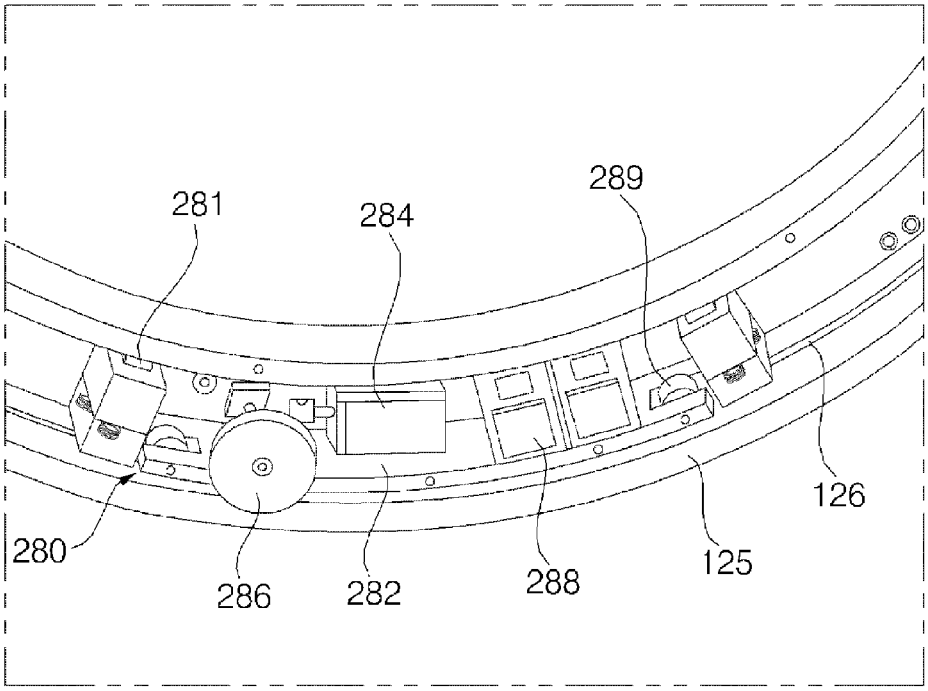

[Fig. 5]
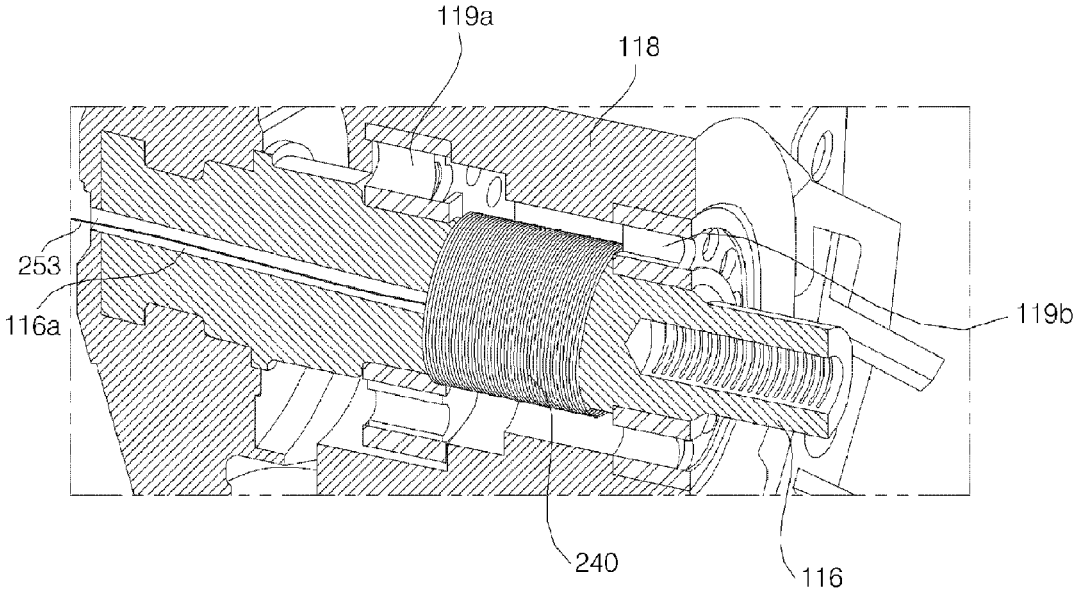
[Fig. 6]
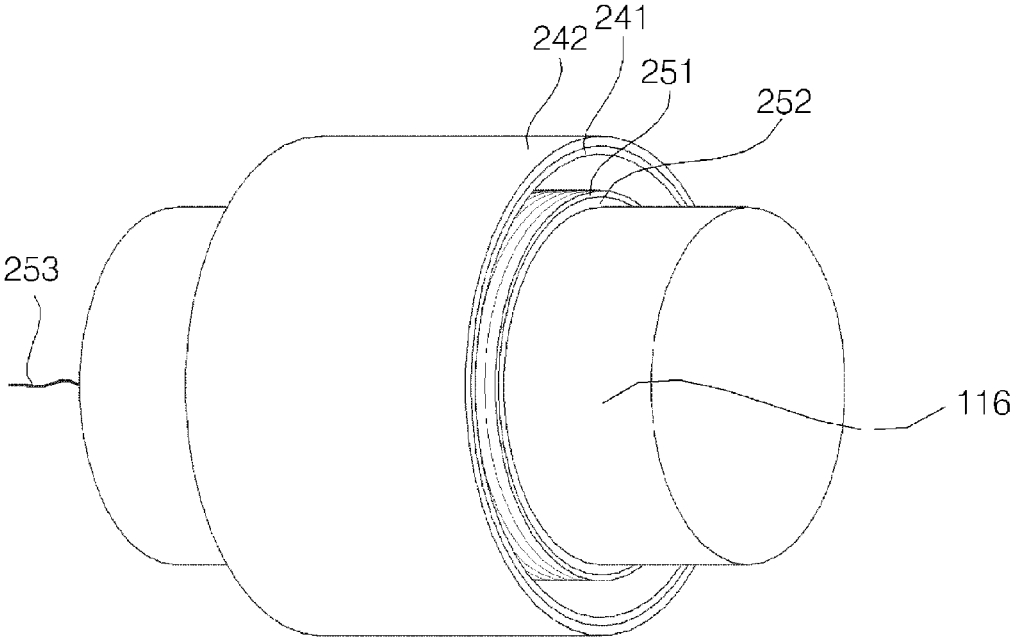

[Fig. 7]
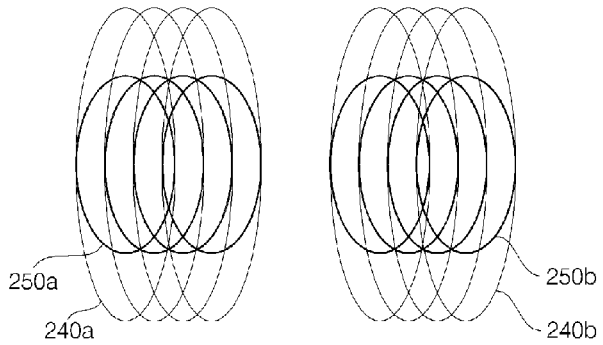
(a)
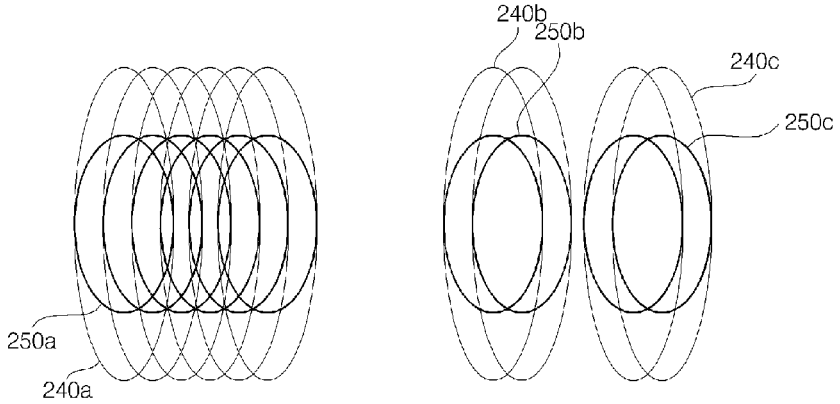
(b)

[Fig. 8]
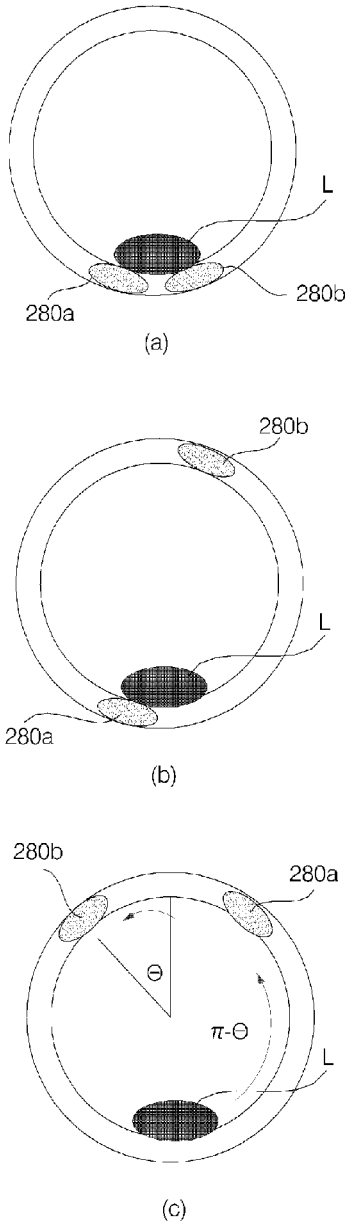

WASHING MACHINE

This application is a 35 USC § 371 National Stage entry of International Application No. PCT/KR2012/002110, filed on Mar. 23, 2012, and claims priority of Korean Application No. KR 10-2011-0079736 filed Aug. 10, 2011, which are each hereby incorporated by reference in their entirety.

TECHNICAL FIELD

The present invention relates to a washing machine and, more particularly, to a washing machine which actively resolves unbalancing.

BACKGROUND ART

In general, a washing machine is a device for decontaminating clothes, bedding, and the like, (referred to as 'laundry', hereinafter) by using water, a detergent, and a mechanical operation through processes such as washing, rinsing, spin-drying, and the like, to thus clean the laundry.

Washing machines are classified into an agitator type washing machine, a pulsator type washing machine, and a drum type washing machine.

The agitator type washing machine performs washing by horizontally rotating a washing bar rising at the center of a washing tub. The pulsator type washing machine performs washing by using frictional force between a water stream and laundry generated by horizontally rotating a rotary blade having a disk-like shape formed at a lower portion of a washing tub. The drum type washing machine performs washing by putting water, a detergent, and laundry into the interior of a drum and then rotating the drum.

In the drum type washing machine, a tub accommodating washing water is mounted within a cabinet forming an external appearance, a drum accommodating laundry is disposed at an inner side of the tub, a motor for rotating the drum is mounted at a rear side of the tub, and a drive shaft connected to a rear side of the drum through the tub is axially installed at the motor. A lifter is mounted within the drum to draw up laundry when the drum is rotated.

In such a washing machine, a phenomenon in which laundry is entangled to be inclined to one side occurs, causing eccentricity such that one side becomes heavier based on the center of the drum. When the drum is rotated at a high speed with the laundry disposed partially (i.e., lopsided or unbalanced) therein (e.g., when the laundry is spin-dried), vibration and noise are generated due to unbalancing resulting from a discrepancy between the geometrical center of a rotational shaft of the drum and the actual center of gravity. In order to reduce such vibration and noise, a device, which is called a balancer, for reducing unbalancing of the drum is installed.

As a balancer for a drum type washing machine, a counter weight that corrects partial disposition (eccentricity) by attaching additional mass has been used, but recently, a ball balancer configured by forming an annular space having a certain breadth in a circumferential direction on a front surface or a rear surface of the drum, inserting balls into the space, filling the space with a liquid, and then, completely hermetically closing the space through heat fusion is commonly employed. When the drum is rotated at a high speed, the ball balancer is distributed to allow an internal material to move to the opposite side of the center of gravity of laundry, thus making the center of gravity of the drum close to the center of rotation.

However, such a ball balancer is passively rotated according to a rotation of the drum, having a problem in which the balancer cannot be disposed at a desired position.

DESCRIPTION OF DRAWINGS

The above and other objects and features of the present invention will become apparent from the following description of preferred embodiments given in conjunction with the accompanying drawings, in which:

FIG. 1 is a sectional view of a washing machine according to an embodiment of the present invention.

FIG. 2 is a schematic block diagram of the washing machine illustrated in FIG. 1.

FIG. 3 is a partial perspective view of the washing machine illustrated in FIG. 1.

FIG. 4 is a view showing a balancing unit of the washing machine according to an embodiment of the present invention.

FIG. 5 is a partially cut perspective view of the washing machine according to an embodiment of the present invention.

FIG. 6 is a partial perspective view of the washing machine according to an embodiment of the present invention.

FIG. 7 is a view showing various examples of a transmission coil unit and a reception coil unit of the washing machine according to an embodiment of the present invention.

FIG. 8 is a view showing a balancing method of the washing machine according to an embodiment of the present invention.

BEST MODE

The foregoing and other objects, features, aspects and advantages of the present invention will be described in detail through embodiments described hereinafter in conjunction with the accompanying drawings. However, embodiments of the present invention may, however, be implemented in many different forms and should not be construed as being limited to the embodiments set forth herein. Rather, these embodiments are provided so that this disclosure will be thorough and complete, and will fully convey the scope of the invention to those skilled in the art and are defined by the claim coverage of the present invention. Throughout the specification, the same reference numerals will be used to designate the same or like components.

Hereinafter, a washing machine according to embodiments of the present invention will be described with reference to the accompanying drawings.

FIG. 1 is a sectional view of a washing machine according to an embodiment of the present invention. FIG. 2 is a schematic block diagram of the washing machine illustrated in FIG. 1. FIG. 3 is a partial perspective view of the washing machine illustrated in FIG. 1.

The washing machine 100 according to an embodiment of the present invention includes a cabinet 111 forming an external appearance, a door 112 opening and closing one side of the cabinet 111 such that laundry is taken into or out of the cabinet 111, a tub 122 disposed within the cabinet 111 and supported by the cabinet 111, a drum 124 disposed within the tub 122 and receiving and rotating laundry, a drum motor 113 applying torque to the drum 124 to rotate the drum 124, a detergent box 133 accommodating a detergent, and a control panel 114 receiving a user input and displaying a state of the washing machine.

The cabinet 111 includes a laundry entry hole allowing laundry to be taken in or out therethrough. The door 112 is rotatably coupled to the cabinet 111 such that the laundry entry hole is open and closed. The control panel 114 is provided on the cabinet 111. The detergent box 133 is provided in the cabinet 111 such that it can be drawn out.

The tub 122 is disposed to be buffered by a spring 115 and a damper 117 within the cabinet 111. The tub 122 accommodates washing water. The drum 124 is disposed within the tub 122

The drum motor 113 generates rotary force. The drum motor 113 is connected to a rotational shaft 116 to rotate the drum 124. The drum motor 113 may be able to rotate the drum 124 at various speeds or in various directions. The drum motor 113 includes a stator (not shown) on or around which a coil is wound and a rotor (not shown) rotated by generating an electromagnetic interaction with the coil. The rotor (not shown) of the drum motor 113 is connected to the rotational shaft 116.

The drum 124 with laundry accommodated therein is rotated. The drum 124 includes a plurality of through holes formed to allow washing water to pass therethrough. A lifter 125 may be disposed on an inner wall of the drum 124 in order to lifting laundry by a certain height. The drum 124 is rotated upon receiving rotary force of the drum motor 113 by the rotational shaft 116.

The rotational shaft 116 connects the drum motor 113 and the drum 124. The rotational shaft 116 transfers the rotary force from the drum motor 113 to the drum 124 to rotate the drum 124. One end of the rotational shaft 116 is coupled to the rotation center of the rear side of the drum 124, and the other end of the rotational shaft 116 is coupled to the rotor (not shown). The rotational shaft 116 is supported by a plurality of bearings 119.

The plurality of bearings 119 rotatably support the rotational shaft 116. The plurality of bearings 119 are coupled to the circumference of the rotational shaft 116. Various types of bearings may be used as the plurality of bearings 119, and in the present embodiment, the plurality of bearings 119 are ball bearings. In the present embodiment, the plurality of bearings 119 include a first bearing 119*a* disposed at the drum 124 side and a second bearing 119*b* disposed at the drum motor 113 side. The first bearing 119*a* and the second bearing 119*b* are spaced apart to support the rotational shaft 116.

A bearing housing 118 is coupled to a tub 122 to support a plurality of bearings 119. The bearing housing 118 is coupled to a rear side of the tub 122. The bearing housing 118 has a hollow allowing the rotational shaft 116 to pass therethrough, and the plurality of bearings 119 are provided to be spaced apart in the hollow. A stator (not shown) of the drum motor 113 is connected to a rear side of the bearing housing 118.

A gasket 128 hermetically seals a gap between the tub 122 and the cabinet 111. The gasket 128 is disposed between the entrance of the tub 122 and the laundry entry hole. The gasket 128 lessens impact transferred to the door 112 when the drum 124 is rotated, and prevents washing water within the tub 122 from being leaked to the outside. The gasket 128 may include a circulation nozzle 127 allowing washing water to be introduced into the drum 124.

The detergent box 133 accommodates a detergent such as a washing liquid, a fabric conditioner, a decolorant, and the like. Preferably, the detergent box 133 is provided on a front surface of the cabinet 111 such that it can be drawn out. When washing water is supplied, the detergent within the detergent box 133 is mixed with washing water and then introduced into the tub 122.

Within the cabinet 111, preferably, there are provided a water supply valve 131 for adjusting an inflow of washing water from an external water source, a water supply flow path 132 along which washing water introduced to the water supply valve 131 flows to the detergent box 133, and a water supply pipe 134 through which washing water mixed with the detergent in the detergent box 133 flows to the interior of the tub 122.

Within the cabinet 111, preferably, there are provided a drain pipe 135 through which washing water within the tub 122 flows out, a pump 136 for making washing water within the tube 122 flow out, a circulation flow path 137 for circulating washing water, the circulation nozzle 127 allowing washing water to flow into the drum 124, and a drain flow path 138 along which washing water is drained to the outside. According to an embodiment, the pump 136 may be provided as a circulation pump and a drain pump which are connected to the circulation flow path 137 and the drain flow path 138, respectively.

A balancing unit 280 moves along the circumference of the drum 124 to change the center of gravity of the drum 124. Here, the center of gravity of the drum 124 refers to the common center of gravity of objects including the drum 124, laundry accommodated in the drum 124 and rotating together with the drum 124 when the drum 124 is rotated, the guide rail 125, the balancing unit 280, the rotational shaft 116, and any other components attached to the drum 124, rather than referring to the center of gravity of the drum 124 alone.

When laundry is partially disposed (or becomes eccentric), the balancing unit 280 moves along a circumferential direction of the drum 124 to adjust the center of gravity of the drum 124. When the drum 124 is rotated with laundry partially disposed therein, vibration and noise are generated due to unbalancing resulting from a discrepancy between the geometrical center of the rotational shaft 116 and the actual center of gravity. The balancing unit 280 reduces unbalancing of the drum 124 by adjusting the center of gravity of the drum 124 such that it is close to the rotational shaft 116. A plurality of balancing units 180 may be provided, and in this embodiment, two balancing units, namely, a first balancing unit 280*a* and a second balancing unit 280*b*, are provided. Preferably, the first balancing unit 280*a* and the second balancing unit 280*b* move in different directions.

The balancing unit 280 may be provided at a front side and/or rear side of the drum 124. In the present embodiment, the balancing unit 280 is provided at a front side of the drum 124. When the drum 124 is rotated, laundry accommodated in the drum 124 generally gathers at an inner side, i.e., at a rear side, of the drum 124, so in order to make balance with the laundry gathering at the rear side of the drum 124, preferably, the balancing unit 280 is provided at the front side of the drum 124. The balancing unit 280 moves along a guide rail 125 provided on the circumference of the drum 124. The balancing unit 280 will be described later in detail with reference to FIG. 4.

The guide rail 125 is a passage along which the balancing unit 280 passes. The guide rail 125 has an annular shape and provided on the front side and/or the rear side of the drum 124. In this embodiment, the guide rail 125 is coupled to a front edge of the drum 124. The guide rail 125 may have protrusions and depressions formed thereon in order to prevent the balancing unit 280 from being released. A guide rail electric wire 126 may be provided at the guide rail 125 in order to transfer power to the balancing unit 280. The guide rail electric wire 126 is insulated from the guide rail 125.

The control panel 114 may include an input unit (not shown) for receiving various operational commands such as a washing course selection, setting an operation time of each process, making a reservation, and the like, from a user, and a display unit (not shown) displaying an operational state of the washing machine 100.

With reference to FIG. 2, the washing machine according to an embodiment of the present invention includes a power supply unit 210 supplying power from the outside and a wireless power transmission unit 200 wirelessly transmitting power supplied from the power supply unit 210 to the balancing unit 280.

The power supply unit 210 converts commercial power as an alternating current (AC) supplied from the outside into appropriate power. In the present embodiment, the power supply unit 210 is a switched-mode power supply which converts commercial power into a 14V direct current (DC). The power supply unit 210 may be provided at a certain position within the cabinet 111 or in the control panel 114. Power supplied after being converted by the power supply unit 210 may also be supplied to the drum motor 113.

The wireless power transmission unit 200 wirelessly transmits power supplied from the power supply unit 210. If the power supply unit 210 provided in the cabinet 111 or the control panel 114 is connected to the balancing unit 280 provided in the drum 124 through a fixed line, a problem may arise when the drum 124 is rotated. Thus, the wireless power transmission unit 200 wirelessly transmits power supplied from the power supply unit 210 to the balancing unit 280.

The wireless power transmission unit 200 may include an oscillation unit 220, an amplifying unit 230, a transmission coil unit 240, a reception coil unit 250, a rectifying unit 260, and an adjusting unit 270.

The oscillation unit 220, an oscillator, causes a voltage variation width in power supplied from the power supply unit 210 such that a magnetic field may be generated in the transmission coil unit 240. The amplifying unit 230 amplifies power such that the transmission coil unit 240 may obtain a sufficient current.

The transmission coil unit 240 generates a magnetic field, and the reception coil unit 250 generates power according to electromagnetic induction from the magnetic field generated by the transmission coil unit 240. The transmission coil unit 240 and the reception coil unit 250 will be described later in detail with reference to FIGS. 5 and 6.

The rectifying unit 260 converts power generated by the reception coil unit into DC power. The adjusting unit 270 adjusts the rectified power into a certain voltage and current.

According to an embodiment of the present invention, the wireless power transmission unit 200 may include a storage unit (not shown) temporarily storing power adjusted by the adjusting unit 270, and here, the storage unit (not shown) may be configured as a capacitor, a battery, or the like.

FIG. 4 is a view showing the balancing unit of the washing machine according to an embodiment of the present invention.

The balancing unit 280 according to an embodiment of the present invention includes a frame 282, a body 288, a wheel 286, a motor 284, a contact terminal 289, and a brake 281.

The frame 282, forming a skeleton of the balancing unit 280, includes the wheel 286, the body 288, the motor 284, and the like. Preferably, the frame 282 is formed to have an arc shape according to the shape of the guide rail 125.

The body 288 may have an appropriate weight to serve as a mass body. According to an embodiment of the present invention, the foregoing adjusting unit 270 and/or the rectifying unit 260 may be accommodated in the body 288.

The wheel 286 rolls along the guide rail 125 such that the balancing unit 280 is movable. The wheel 286 may be made of a material having great frictional force. The wheel 286 is rotated by the motor 284. According to an embodiment, the wheel 286 may be replaced by a gear, and in this case, a pinion gear or a worm gear may be used. Also, when the wheel 286 is replaced by a gear, a rack gear or a worm wheel may be formed on the guide rail 125.

The motor 284 rotates the wheel 286. The motor 284 generates rotary force upon receiving power from the wireless power transmission unit 200.

The contact terminal 289 comes into contact with the guide rail electric wire 126 to transfer power supplied from the wireless power transmission unit 200 to the motor 284. Preferably, the contact terminal 289 is made of a metallic material having low frictional force so that it may be maintained to be in contact with the guide rail electric wire 126 and a power loss is not made.

The brake 281 enables the balancing unit 280 to be stopped at a particular position of the guide rail 125. The guide rail 125 is rotated together with the drum 124, so the brake 281 is required to prevent the balancing unit 280 from being freely rotated. The brake 281 applies force in the opposite direction of the wheel 286 to fix the balancing unit 280 to the guide rail 125.

FIG. 5 is a partially cut perspective view of the washing machine according to an embodiment of the present invention. FIG. 6 is a partial perspective view of the washing machine according to an embodiment of the present invention.

The reception coil unit 250 is disposed at the circumference of the rotational shaft 116, and the transmission coil unit 240 is disposed at the circumference of the reception coil unit 250 such that it is spaced apart from the reception coil unit 250. The transmission coil unit 240 is provided within the bearing housing 118, and provided between a first bearing 119*a* and a second bearing 119*b* disposed to be spaced apart. The reception coil unit 250 is fixedly disposed between the first bearing 119*a* and the second bearing 119*b*, while the transmission coil unit 240 is rotated together with a rotational shaft which rotates according to a rotation of the drum motor 113.

The transmission coil unit 240 includes a transmission coil 241 and a transmission shielding member 242. The transmission coil 241 is wound in a cylindrical shape and generates a magnetic field from power supplied from the power supply unit 210. The transmission shielding member 242 is provided at an outer side of the transmission coil 241 to prevent electromagnetic induction between the transmission coil 241 and the reception coil 251 from being interfered with by an external magnetic field.

The reception coil unit 250 includes a reception coil 251, a reception shielding member 252, and a reception electric wire 253. The reception coil 251 is wound in a cylindrical shape and generates power according to electromagnetic induction from the magnetic field generated by the transmission coil 241. The reception shielding member 252 is provided within the reception coil 251, namely, between the rotational shaft 116 and the reception coil 251 to prevent electromagnetic induction between the transmission coil 241 and the reception coil 251 from being interfered with by a magnetic field of the rotational shaft 116 side. The reception electric wire 253 connects the reception coil 251 and the guide rail electric wire 126 to allow power generated from the reception coil 251 to be transmitted to the guide rail electric wire 126. The reception electric wire 253 is connected to the guide rail electric wire 126 through a hollow 116*a* of the rotational shaft 116 and the rear side of the drum 124, and across the outer side of the drum 124. The reception electric wire 253 may be insulated from the rotational shaft 116 and the drum 124.

The washing machine according to an embodiment of the present invention as described above operates as follows.

The user opens the door 112, puts laundry into the drum 124, and manipulates the control panel 114 to operate the washing machine. When the washing machine is operated, a washing process of wetting the laundry with washing water mixed with a washing detergent and rotating the drum 124 to decontaminate the laundry, a rinsing process of wetting the laundry with washing water mixed with a fabric conditioner and rotating the drum 124 to remove a remaining washing detergent of the laundry, and a spin-drying process of rotating the drum 124 at a high speed to spin-dry the laundry are sequentially performed. Water supplying, washing, rinsing, draining, spin-drying, drying, and the like, are performed in each process.

Spin-drying, which refers to rotating the drum 124 at a high speed to remove washing water from the laundry, is performed in the washing process, the rinsing process, and the spin-drying process. In case of spin-drying, the drum 124 is rotated at 400 rpm or greater, and at a maximum of 1000 rpm. Thus, if the drum 124 is greatly unbalanced, a great amount of vibration and noise are generated.

Thus, when spin-drying starts, the balancing unit 280 is moved to an appropriate position such that the center of gravity of the drum 124 is close to the rotational shaft 116, and then, the drum motor 113 is accelerated.

In order to move the balancing unit 280 to an appropriate position, the wireless power transmission unit 200 wirelessly transmits power supplied from the power supply unit 210 to the balancing unit 280. The oscillation unit 220 of the wireless power transmission unit 200 generates a voltage variation width, and the amplifying unit 230 amplifies power, and the transmission coil 241 of the transmission coil unit 240 generates a magnetic field. When the reception coil 251 of the reception coil unit 250 generates power by electromagnetic induction from the magnetic field, the generated power is transmitted to the guide rail electric wire 126 through the reception electric wire 253. The contact terminal 289 of the balancing unit 280 is in contact with the guide rail electric wire 126 to receive power. The rectifying unit 260 provided in the body 288 of the balancing unit 280 changes the power received by the contact terminal 289 into DC power, and the adjusting unit 270 adjusts the changed DC power into a certain voltage and current. The power adjusted by the adjusting unit 270 is supplied to the motor 284, and when the motor generates rotary force to rotate the wheel 286, the balancing unit 280 is moved. When the balancing unit 280 is moved to an appropriate position, the brake 281 is operated to fix the balancing unit 280.

As for the appropriate position to which the balancing unit 280 is moved, the speed of revolution of the motor 113 is uniformly maintained to measure an unbalanced degree of the drum 124, and when an unbalanced degree is minimized while the balancing unit 280 is moving, the brake 281 may be operated to position the balancing unit 280. Also, the balancing unit 280 may be moved to a previously stored position according to an unbalanced degree. This will be described in detail later with reference to FIG. 8.

FIG. 7 is a view showing various examples of the transmission coil unit and the reception coil unit of the washing machine according to an embodiment of the present invention.

In an embodiment of the present invention, a plurality of transmission coil units 240 and a plurality of reception coil units 250 may be provided. When the balancing unit 280 is provided as a plurality of balancing units, namely, the first balancing unit 280*a* and the second balancing unit 280*b*, the plurality of transmission coil units 240 and the plurality of reception coil units 250 serve to move the respective balancing units 280.

A plurality of guide rail electric wires 126 may be provided at the guide rail 125 in order to transfer power to the respective balancing units 280.

A plurality of reception electric wire 253 may be provided in order to connect a plurality of reception coils 251 and the plurality of guide rail electric wires 126.

The plurality of reception coil units 250 are provided to be spaced apart from each other at the circumference of the rotational shaft 116, and the plurality of transmission coil units 240 are provided to be spaced apart from each other at the each circumference of the plurality of reception coil units 250. Preferably, the plurality of reception coil units 250 are insulated from each other, and the plurality of transmission coil units 240 are insulated from each other.

With reference to FIG. 7(*a*), two transmission coil units 240 and two reception coil units 250 may be provided. A first transmission coil unit 240*a* and a first reception coil unit 250*a* transmit power to the first balancing unit 280*a*, and a second transmission coil unit 240*b* and a second reception coil unit 250*b* transmit power to the second balancing unit 280*b*.

The wireless power transmission unit 200 supplies power to the first transmission coil unit 240*a* or the second transmission coil unit 240*b* to move the first balancing unit 280*a* or the second balancing unit 280*b*, respectively. Preferably, the first balancing unit 280*a* and the second balancing unit 280*b* are moved in different directions.

With reference to FIG. 7(*b*), three transmission coil units 240 and three reception coil u nits 250 may be provided. A first transmission coil unit 240*a* and a first reception coil unit 250*a* transmit power to the first balancing unit 280*a* and the second balancing unit 280*b*. A second transmission coil unit 240*b* and a second reception coil unit 250*b* transmit power to the first balancing unit 280*a*. A third transmission coil unit 240*c* and a third reception coil unit 250*c* transmit power to the second balancing unit 280*b*.

The first balancing unit 280*a* and the second balancing unit 280*b* include a logical gate to implement advancing (moving forward) and backing (moving backward) of the first balancing unit 280*a* and the second balancing unit 280*b* according to a combination of the first reception coil unit 250*a*, the second reception coil unit 250*b*, or the third reception coil unit 250*c*.

For example, when the wireless power transmission unit 200 supplies power only to the first reception coil unit 250*a*, the first balancing unit 280*a* and the second balancing unit 280*b* move forward. When the wireless power transmission unit 200 supplies power to the first reception coil unit 250*a* and the second reception coil unit 250*b*, the first balancing unit 280*a* may move backward and the second balancing unit 280*b* may move forward.

FIG. 8 is a view showing a balancing method of the washing machine according to an embodiment of the present invention.

As shown in FIG. 8(*a*) the first balancing unit 280*a* and the second balancing unit 280*b* are gathered. In this case, the first balancing unit 280*a* and the second balancing unit 280*b* may be gathered by moving them in different directions, respectively, or may be gathered by moving the other in a state in which any one of them is stopped. When the first balancing unit 280*a* and the second balancing unit 280*b* are gathered, an overload is generated in the power supply unit 210, so the overload can be detected.

In the state in which the first balancing unit 280*a* and the second balancing unit 280*b* are gathered, as shown in FIG. 8(*b*), the first balancing unit 280*a* and the second balancing unit 280*b* are moved, respectively, during which an unbalanced degree of the drum 124 is measured. When the unbalanced degree is minimized, the first balancing unit 280*a* and the second balancing unit 280*b* are stopped.

According to an embodiment of the present invention, as shown in FIG. 8(*c*), the first balancing unit 280*a* and the second balancing unit 280*b* may be moved to optimized positions from the position at which the unbalanced degree is minimized. Namely, the first balancing unit 280*a* and the second balancing unit 280*b* are moved, respectively, according to previously stored data. In this embodiment, the second balancing unit 280*b* is moved by $\theta$, and the first balancing unit 280*a* is moved by $\pi$-$\theta$.

The washing machine according to embodiments of the present invention has one or more advantages as follows.

First, unbalancing can be solved by actively moving an unbalancing unit.

Second, power is wirelessly transmitted to the unbalancing unit that is actively moved.

Third, a transmission coil and a reception coil wirelessly transmitting power can be effectively disposed in the washing machine.

The advantages of the present invention are not limited to the foregoing advantages, and any other advantages not mentioned will be clearly understood from the following detailed description of claims by those skilled in the art.

While the present invention has been shown and described in connection with the embodiments, it will be apparent to those skilled in the art that modifications and variations can be made without departing from the spirit and scope of the invention as defined by the appended claims.

The invention claimed is:

1. A washing machine comprising:

a drum accommodating laundry and configured to be rotatable;

a balancing unit moving along the circumference of the drum and changing the center of gravity of the drum;

a wireless power transmission unit wirelessly supplying power to the balancing unit;

a guide rail provided at the circumference of the drum and allowing the balancing unit to move therealong; and a guide rail electric wire provided at the guide rail to transfer power supplied from the wireless power transmission unit to the balancing unit, wherein the balancing unit comprises, a frame;

a wheel disposed at the frame to roll along the guide rail;

a motor to rotate the wheel; and a contact terminal contacting with the guide rail electric wire to transfer power supplied from the wireless power transmission unit to the motor.

2. The washing machine of claim 1, wherein the wireless power transmission unit comprises:

a transmission coil unit generating a magnetic field from power; and a reception coil unit generating power from the magnetic field generated by the transmission coil unit and supplying the generated power to the balancing unit.

3. The washing machine of claim 2, wherein the reception coil unit comprises a reception coil and a reception shielding member provided within the reception coil, and the transmission coil unit comprises a transmission coil and a transmission shielding member provided at an outer side the transmission coil.

4. The washing machine of claim 2, further comprising:

a drum motor generating rotary force; and a rotational shaft connecting the drum motor and the drum to transfer rotary force of the drum motor to the drum, wherein the reception coil unit is disposed at the circumference of the rotational shaft, and the transmission coil unit is disposed at the circumference of the reception coil unit such that the transmission coil unit is spaced apart from the reception coil unit.

5. The washing machine of claim 4, further comprising a plurality of bearings spaced apart to rotatably support the rotational shaft, wherein the transmission coil unit and the reception coil unit are provided between the plurality of bearings.

6. The washing machine of claim 5, further comprising a bearing housing supporting the plurality of bearings, wherein the transmission coil unit and the reception coil unit are provided within the bearing housing.

7. The washing machine of claim 2, wherein a plurality of balancing units are provided, wherein a plurality of transmission coil units are provided and a plurality of reception coil units are provided.

8. The washing machine of claim 7, wherein the plurality of reception coil units are provided to be spaced apart from each other and the plurality of transmission coil units are provided to be spaced apart from each other.

9. The washing machine of claim 7, wherein the plurality of reception coil units are insulated from each other, and the plurality of transmission coil units are insulated from each other.

10. The washing machine of claim 1, wherein the guide rail electric wire is insulated from the guide rail.

11. The washing machine of claim 1, further comprising a reception electric wire connecting the wireless power transmission unit and the guide rail electric wire.

12. The washing machine of claim 11, further comprising:

a drum motor generating rotary force; and a rotational shaft connecting the drum motor and the drum to transfer rotary force of the drum motor to the drum, wherein the reception electric wire is connected to the guide rail electric wire through a hollow of the rotational shaft and the rear side of the drum, and across the outer side of the drum.

13. The washing machine of claim 11, wherein the wireless power transmission unit comprises a plurality of transmission coil units and a plurality of reception coil units, wherein the guide rail electric wire is provided as a plurality of guide rail electric wires and the reception electric wire is provided as a plurality of reception electric wires.

14. The washing machine of claim 6, wherein the reception coil unit comprises a reception coil and a reception shielding member provided within the reception coil, and the transmission coil unit comprises a transmission coil and a transmission shielding member provided at an outer side the transmission coil.

15. The washing machine of claim 14, wherein the reception coil unit further comprises a reception electric wire connected to the reception coil provided through a hollow of the rotational shaft.

16. The washing machine of claim 15, wherein the reception electric wire is insulated from the rotational shaft.

17. The washing machine of claim 6, wherein a plurality of transmission coil units are provided and a plurality of reception coil units are provided.

* * * * *